United States Patent [19]

Vitale

[11] 4,279,045

[45] Jul. 21, 1981

[54] CORNER POCKET FOR SECURING MATTRESS COVERS AND THE LIKE

[75] Inventor: Joseph Vitale, Charlotte, N.C.

[73] Assignee: PRF Corporation, Monroe, N.C.

[21] Appl. No.: 113,899

[22] Filed: Jan. 21, 1980

[51] Int. Cl.[3] ..... A47G 9/02

[52] U.S. Cl. ..... 5/497; 5/499

[58] Field of Search ..... 5/485, 490, 497, 499; 112/262

[56] References Cited

U.S. PATENT DOCUMENTS

| | | | |
|---|---|---|---|
| 2,491,894 | 12/1949 | Fox . | |
| 2,662,234 | 12/1953 | Citron | 5/497 |
| 2,789,292 | 4/1957 | Budinquest | 5/497 |
| 2,963,715 | 12/1960 | Young | 5/497 |
| 3,092,848 | 6/1963 | Gronvold . | |
| 3,111,688 | 11/1963 | Barnes | 5/497 |
| 3,208,419 | 9/1965 | Frydryk | 112/262 |
| 3,644,832 | 10/1972 | Jamison | 5/497 |
| 3,795,019 | 3/1974 | Fragas | 5/497 |
| 3,996,633 | 12/1976 | Burke | 5/497 |
| 4,045,832 | 9/1977 | Di Forti et al. | 5/497 |

FOREIGN PATENT DOCUMENTS

| | | | |
|---|---|---|---|
| 626223 | 4/1963 | Belgium | 5/497 |

*Primary Examiner*—Casmir A. Nunberg

*Attorney, Agent, or Firm*—Seidel, Gonda, Goldhammer & Panitch

[57] ABSTRACT

A cover pocket for securing the corners of a mattress cover to a mattress or box spring which is made from a rectangular flexible material. The material to be made into the corner pocket has notches at opposite corners which overlay each other. Folding in a specific manner and fastening by stitching to a matress cover results in the corner pocket to be attached at each of the corners of the mattress cover.

3 Claims, 6 Drawing Figures

CORNER POCKET FOR SECURING MATTRESS COVERS AND THE LIKE

BACKGROUND OF THE INVENTION

In the past bedsheets and mattress covers have been held to mattresses and/or boxsprings by means of elastic bands at each corner thereof. These bands are attached to the mattress cover at two points equidistant from a corner thereof and then passed beneath the mattress or boxspring to hold the cover in place. The elastic bands are provided at each of the four corners of the bed sheet or mattress pad.

Other constructions such as nonpermanent elastic bands fitted under the mattress or boxsprings and attached to the matress pad by clips have been used. Another construction is to manufacture the bedsheet or mattress pad with side panels extending over the sides and part of the bottom of the mattress or bedsprings, stitching these panels together at the corners, and inserting an elastic strip at the corners to retain the overlap of the side panels under the mattress or bedsprings.

The above constructions have been adapted for use in different applications such as a baby's crib, a round rather than rectangular bed or a water bed. However, none of these modifications describe a corner pocket for securing a bed sheet or mattress cover as disclosed by the present invention.

SUMMARY OF THE INVENTION

This invention is directed to a corner pocket for securing the corners of bed clothing to the mattress or bedspring below. Each corner pocket is made of a substantially square piece of cloth with cutouts or notches at opposite corners. The cloth is then folded so that the notches overlap each other and then folded again along a line perpendicular to the first fold and bisecting a corner of the notches. This folding technique results in a polygon which is then stitched together along the exposed sides of the notches. The longer side adjacent the seam holding the notch sides together is then spread apart and attached to a corner of the mattress pad or sheet by stitching. When attached in this manner, the single piece of cloth unfolds to form a corner pocket. This pocket when attached at each of the four corners of a rectangular mattress pad or sheet firmly secures the pad to the mattress. Each of the corners is designed to tuck under a corner of a mattress approximately four inches.

BRIEF DESCRIPTION OF THE DRAWINGS

For the purpose of illustrating the invention, there is shown in the drawings a form which is presently preferred, it being understood, however, that this invention is not limited to the precise arrangements and instrumentalities shown.

DETAILED DESCRIPTION OF THE INVENTION

Figure 1:
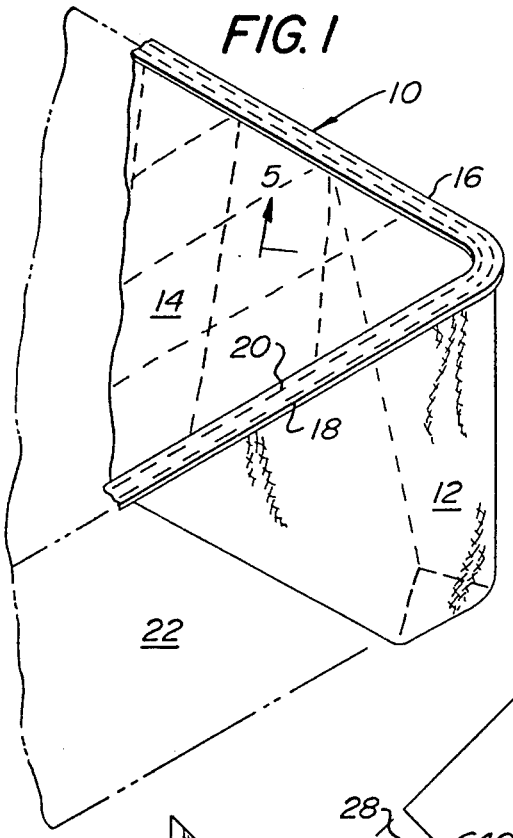
FIG. 1 is a perspective view of the mattress pad with the corner pocket attached.

The present invention is best understood by referring to the drawings wherein like numerals designate like elements.

There is shown in FIG. 1 the corner portion of a mattress pad with the corner pocket attached generally designated by the numeral 10. The corner pocket 12 is attached to the mattress pad 14 along the edge 16 thereof by two lines of stitches 18, 20. The corner pocket 12 is shown holding the mattress pad 14 over the corner of a mattress 22. The mattress pad 14 is shown in a quilted configuration.

Figure 4:
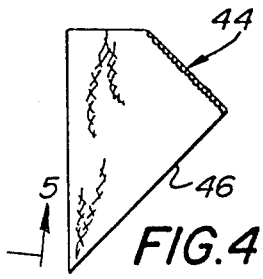
FIG. 4 shows the corner pocket after the second fold with the notch sides stitched together.
Figure 2:
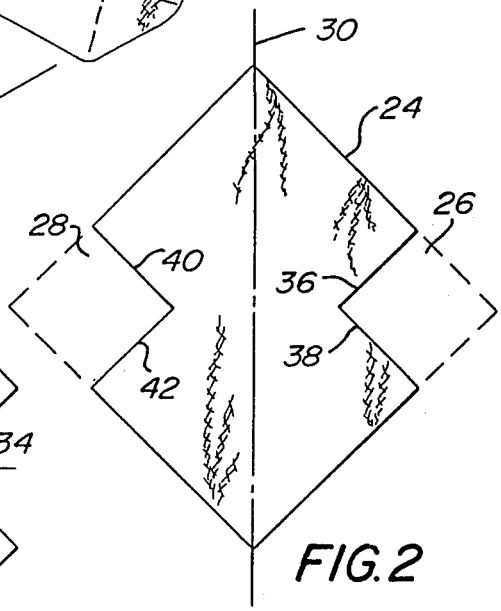
FIG. 2 shows the corner pocket unfolded with two notches at opposite corners thereof.
Figure 3:
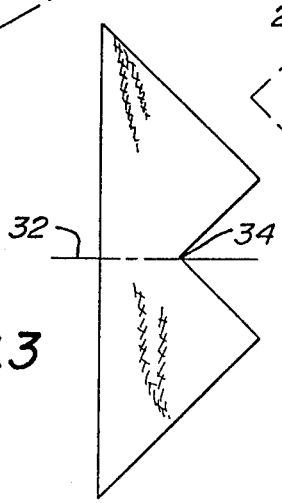
FIG. 3 shows the corner pocket after the first fold.

In FIG. 2 there is shown a substantially square piece of cloth 24 having notches 26, 28 of equal proportion cut out of opposite corners. In order to form the corner pocket 12, the cloth 24 is folded along a line 30 so that the notches 26, 28 overlay each other. The result of this fold is the shape of the cloth shown in FIG. 3 A second fold is taken along a line 32 which is perpendicular to the first fold line 30 and bisects the interior corner 34 of the notches 26, 28. The resulting polygon is shown in FIG. 4. The notch sides 36, 38, 40 and 42 are sewn together by a line of stitches 44. The longer of the two adjacent sides 46 is attached to the mattress pad 14 by stitches 18, 20. When so attached the cloth of the polygonal shape, shown in FIG. 4, can open to form the corner pocket 12 as shown in FIG. 1.

Figure 5:
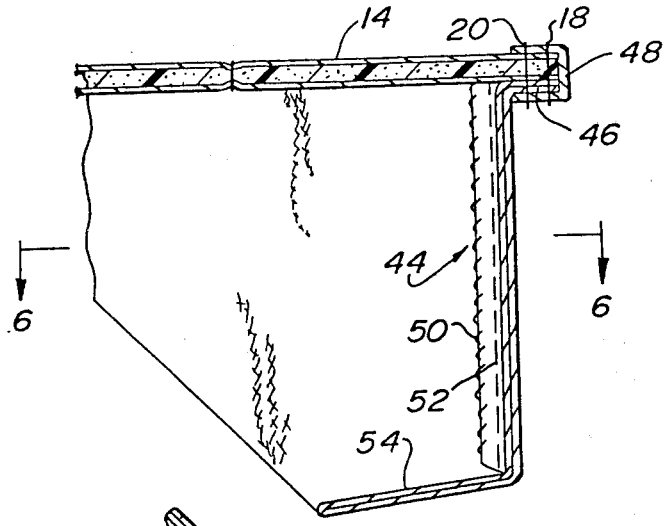
FIG. 5 is a sectional view of FIG. 1 taken along line 5—5.

The stitching lines discussed immediately above are more clearly shown in FIG. 5. The notch sides 36–42 are folded inward slightly before they are joined together by stitches generally designated 44. Two lines of stitches 50, 52 are shown, which prevent the notch sides 36–42 from unravelling. Side 46 can be seen slightly folded under the mattress pad 14 with a cloth ribbon 48 partially enclosing the seam between the mattress pad 14 and the side 46. These pieces are held in place by stitches 18, 20.

Figure 6:
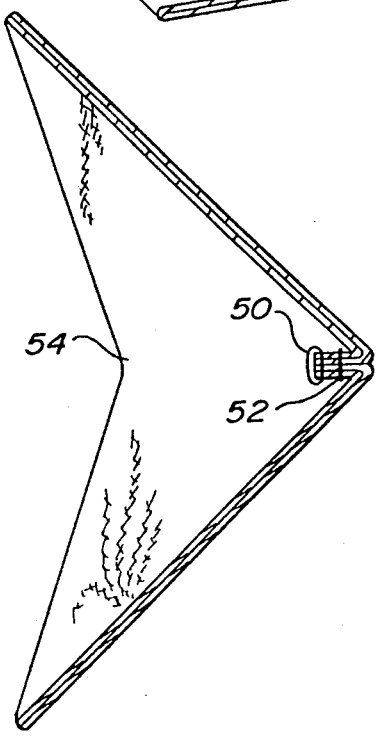
FIG. 6 is a sectional view of FIG. 5 taken along line 6—6.

Once the corner pocket 12 is firmly held in place by its attachment to the mattress pad 14, it can be opened to the configuration shown in FIG. 1. The sectional drawing, FIG. 5, shows that when open, the pocket conforms to the shape of a mattress corner in that the bottom 54 of the corner pocket lies in a horizontal plane substantially parallel to the bottom side of the mattress pad 14. The depth of the pocket can be seen in FIG. 6 which shows that the bottom 54 of the corner pocket extends underneath the mattress in the preferred embodiment for a distance of at least 4 inches. The above described configuration will firmly secure the quilted mattress pad 14 to the mattress at each of its four corners.

The present invention may be embodied in other specific forms without departing from the spirit or essential attributes thereof and, accordingly, reference should be made to the appended claims, rather than to the foregoing specification as indicating the scope of the invention.

I Claim:

1. A mattress cover for overlying the exposed upper surface of a mattress or box spring comprising a substantially flat panel member secured to said mattress by pocket means at each corner thereof, said pocket means comprising a substantially rectangular flexible member having notches at opposite corners thereof, a first fold wherein said notches overlie each other, a second fold along a line perpendicular to said first fold and bisecting a corner of said notches, and the resulting polygon being fastened together along the exposed sides of said notches and fastened to said mattress cover along the longer side adjacent the sides of said notches.

2. Pocket means for securing the corners of bedclothing to the bedding material comprising a substantially rectangular flexible member having notches at opposite corners thereof, a first fold wherein said notches overlie each other and a second fold along a line perpendicular to said first fold and bisecting a corner of said notches wherein the resulting polygon is fastened together along the exposed sides of said notches and fastened to said bed clothing along the longer side adjacent the sides of said notches.

3. Pocket means in accordance with claim 3 wherein one of said pockets is attached to each corner of said bedclothing.

* * * * *